United States Patent [19]

Weiner et al.

[11] Patent Number: 4,576,547

[45] Date of Patent: Mar. 18, 1986

[54] ACTIVE CLEARANCE CONTROL

[75] Inventors: Harvey I. Weiner, South Windsor, Conn.; Kenneth L. Allard, Wilbraham, Mass.

[73] Assignee: United Technologies Corporation, Hartford, Conn.

[21] Appl. No.: 548,466

[22] Filed: Nov. 3, 1983

[51] Int. Cl.[4] ..... F02C 7/16

[52] U.S. Cl. ..... 415/116; 415/175; 60/726

[58] Field of Search ..... 60/39.07, 726, 39.29, 60/39.83; 415/115, 116, 108, 126, 127, 128, 177, 178, 179, 180, 144, 145, 175, 176

[56] References Cited

U.S. PATENT DOCUMENTS

| | | | |
|---|---|---|---|
| 2,837,270 | 6/1958 | Chapman | 415/145 |
| 2,848,156 | 8/1958 | Oppenheimer | 415/108 |
| 3,031,132 | 4/1962 | Davies | 415/115 X |
| 3,647,313 | 3/1972 | Koff | 415/116 X |
| 3,742,706 | 7/1973 | Klompas | 415/115 X |
| 3,844,110 | 10/1974 | Widlansky et al. | 60/39.08 |
| 3,945,759 | 3/1976 | Bobo | 415/145 |
| 4,127,988 | 12/1978 | Becker | 60/726 |
| 4,230,436 | 10/1980 | Davison | 415/175 X |
| 4,268,221 | 5/1981 | Monsarrat et al. | 415/175 X |
| 4,329,114 | 5/1982 | Johnston et al. | 415/116 X |

*Primary Examiner*—Carlton R. Croyle
*Assistant Examiner*—Jeffrey A. Simenauer
*Attorney, Agent, or Firm*—Norman Friedland

[57] ABSTRACT

The bore of the compressor for a gas turbine engine is heated by selectively bleeding compressor air from downstream stages so that heating only occurs at discreet times during the engine operating envelope. The bled air is admitted into the bore at the mid-stage station of the compressor wherein the compressor disks are scrubbed so as to expand and close the gap between the outer air seal and tips of the compressor blades during cruise of the aircraft and prevented from heating the disks during the high powered operations of the engine.

4 Claims, 1 Drawing Figure

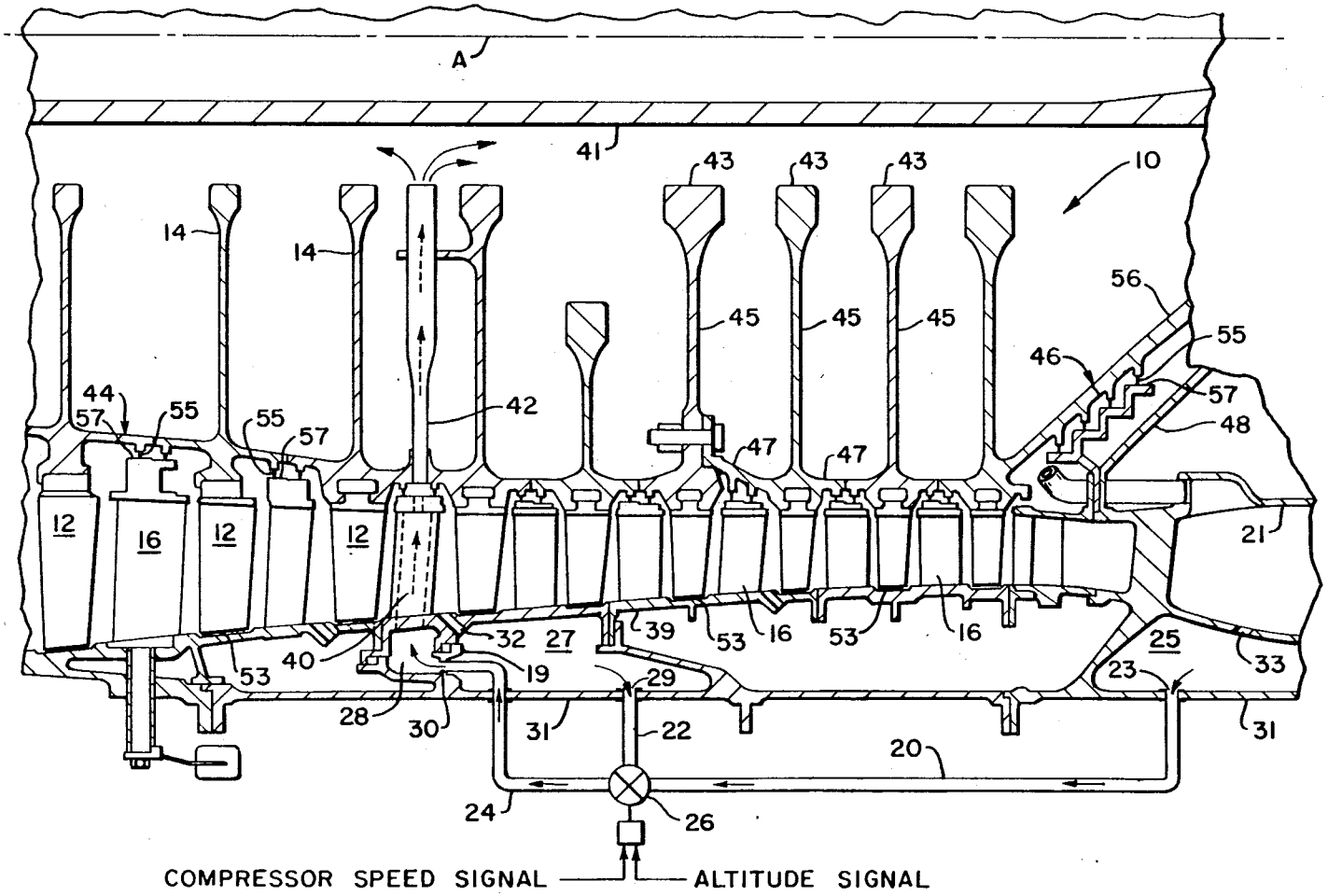
COMPRESSOR SPEED SIGNAL
ALTITUDE SIGNAL

ACTIVE CLEARANCE CONTROL

CROSS REFERENCE

This invention is related to the invention disclosed in copending patent application entitled ACTIVE CLEARANCE CONTROL, filed by Merle L. Dinse and Robert L. Putman on even date and assigned to the same assignee of this patent application.

DESCRIPTION

1. Technical Field

This invention relates to gas turbine engines and particularly to an active clearance control for controlling the clearance between the tips of the axial compressor blades and their attendant peripheral seals.

2. Background Art

As is well known, the aircraft engine industry has witnessed significant improvements in thrust specific fuel consumptions (TSFC) by incorporating active clearance controls on the engines. As for example, the JT9D engine manufactured by Pratt & Whitney Aircraft of United Technologies Corporation, the assignee of this patent application, has been modified to include the active clearance control described and claimed in the Redinger et al U.S. Pat. No. 4,069,662 also assigned to this assignee. In that embodiment spray bars are wrapped around the engine case at judicious locations and fan air is bled to flow through the spray bars so as to impinge air on the engine case so as to cool and hence shrink the case and move the outer air seals, which are attached thereto, toward the tips of the rotor blades. As is referred to in the industry, this is an active clearance control system since the impinging air is only on during certain modes of the engine operating envelope. This is in contrast to the passive type of system that continuously flows air for cooling certain engine parts.

With the utilization of the active clearance control at given locations in the engine, the performance of the engine has increased by more than two (2) percentage points in terms of TSFC. Obviously, it is desirable to minimize the gap of all the rotating blades, and labyrinth seals since any air escaping around the blades and/or seals is a penalty to the overall performance of the engine.

This invention is directed to an active clearance control for the compressor blades and labyrinth seals and operates internally of the engine, rather than externally. Also, this invention contemplates heating the bore of the compressor so as to cause the blades to expand toward the peripheral seals so as to minimize the gap between the tips of the blades and the seal as well as maintaining a close fit of the labyrinth seals. Compressor bleed air which is at a higher pressure and temperature than the incoming air is conducted radially into the bore of the compressor in proximity to the engine's centerline where it scrubs the compressor discs and flows rearwardly to commingle with the working fluid medium. A smaller amount of air does flow forward for the same purpose. This air may also be utilized for other cooling purposes on its travel toward the exit end of the engine. Examples for such use would be for cooling or buffering the bearing compartment, cooling the turbine and the like.

This invention contemplates bleeding compressor discharge air from a low temperature air source, say the 9th stage and a higher temperature air source, say the 15th stage where either the low, high or both temperature airs are directed into the bore of the drum rotor a a judicious location of the high compressor section Preferably, the air is fed into the drum rotor bore at the mid-point of the compressor stages and in a preferred embodiment this would be in proximity to the 9th stage The compressor bleed air is fed through hollow stator vanes communicating with a manifold cavity in the high compressor case and through holes formed in the high compressor rotor adjacent the labyrinth inner air seal. Anti-vortex tubes are utilized to assure the air from the hollow stator flows adjacent the engine centerline. Obviously, this air will then scrub the rotor for cooling-/heating purposes to assure proper contraction and expansion of the compressor rotor. Valving means will open to flow the lower and/or higher temperature air to effectuate this end so that during cruise conditions of the aircraft the higher temperature air will be utilized to expand the compressor discs and hence close the gap of the compressor blades relative to their seals and minimize the gap of the labyrinth seals. In take-off or at high power conditions where the compressor is operating at its highest temperature levels, the cooler air is admitted into the bore so as to contract the compressor discs and prevents the tips of the compressor blades from rubbing against the attendant seals.

DISCLOSURE OF INVENTION

An object of this invention is to provide means for heating the bore of a compressor so that the tips of the compressor expands and moves closer to its peripheral seal in a gas turbine engine. A feature is to provide means for assuring that the bore doesn't become overheated during certain engine operating conditions. The air bled from warmer and cooler stages are introduced into the bore at a mid-way station of the high compressor in proximity to the engine centerline. A feature of this invention is to selectively turn on the air flow from certain stations of the compressor selectively or concomitantly. Another feature of this invention is to feed the bleed air through hollow compressor stators and holes formed between the labyrinth inner air seals. An additional feature of this invention that by the judicious selection of a modulating valve system the volumetric flow of air as well as temperature can be regulated.

Other features and advantages will be apparent from the specification and claims and from the accompanying drawings which illustrate an embodiment of the invention.

BRIEF DESCRIPTION OF DRAWINGS

The sole FIGURE in a partial view in cross section and schematic of the high compressor section of a twin spool gas turbine engine showing the details of this invention.

BEST MODE FOR CARRYING OUT THE INVENTION

While this invention is described in connection with a twin spool gas turbine engine of the type exemplified by the models JT-9D, PW2037 and PW4000 engines manufactured by Pratt & Whitney Aircraft of United Technologies Corporation, the assignee of this patent application, it is to be understood that this invention has application on other types of gas turbine engines. As mentioned in the above, the invention is, in its preferred embodiment employed on the high pressure compressor of the twin spool engine where the compressor air is bled at stages having a higher pressure and temperature than at the point in the engine where it is returned. As can be seen in the sole FIGURE which shows a portion of the high pressure compressor section generally illustrated by reference numeral 10 consists of stages of compression comprising rotors having blades 12 and its attendant disks 14 and a plurality of rows of stator vanes 16. Obviously, as the air progresses downstream, because of the work being done to it by the rotating compressor blades, it becomes increasingly pressurized with a consequential rise in temperature.

In accordance with this invention, air is bled from the 9th stage of compression and a higher stage which is the last stage (15th) in the instance. As is typical in the type of engine the air discharging from the compressor is diffused through a diffuser 21 prior to being fed into the combustor. For the sake of design simplicity, the 15th stage air is bled from the diffuser case 21 through the bleed 33 into the cavity 25 surrounding the diffuser where it is piped out of the engine through the opening 23 in the outer case 31 and the externally mounted conduit 20, and then fed to valve 26. Similarly, air from the 9th stage is bled into the cavity 27 surrounding the compressor inner case 39 through bleed 32 and conducted to line 22 through opening 29 formed in the engine outer case 31 and then fed to valve 26. Obviously, the flow from the 9th stage bleed 32 can be connected internally of the engine case 31 depending on the application, simplicity and convenience of design desired.

This bled air is then directed into the bore area of the compressor through line 24, opening 30 formed in the static seal support 19, into cavity 28, where it is directed radially inward toward the engine centerline A. To accommodate this flow which is in a direction opposing the centrifugal field created by the rotating rotor and shaft one or more vanes 40 are made hollow and communicate with cavity 28. A plurality of anti-vortex tubes 42 (one being shown but the number selected being determined by the flow desired) are attached to the spacer 47 and rotate therewith and communicate with the flow discharging from the ends of the hollow vanes 40 and terminate in close proximity to shaft 41. Because of the pressure selected for the bled air which is controlled by the designed pressure drop a portion of the air will flow forward in the bore area while the majority of the air will flow rearward relative to the direction of flow of the engines fluid working medium. As the air passes through the bores 43 of the disks 14 a portion will scrub the webs 45 and spacers 47 and the heat content transferred from this bled air will cause the disks to expand and hence urge the attached blades 12 toward the peripheral seals 53 and control the gap therebetween.

Similarly, the various labyrinth seals in the compressor section, as in this case of labyrinth seals 44 and 46, will likewise expand and minimize the gap. As shown, the knife edge 55 attached to the outer diameter of spacers 47 will be expanded and contracted as a function of the temperature of the bled air fed into the bore area of the compressor and will move toward and away from land 57. (Although, certain elements are differently dimensioned, it carries the same reference numeral if its function is the same).

To this end, valve 26 is controlled in any well known manner so that air from the 9th stage is fed to the bore area during high powered engine operation such as takeoff and the 15th stage bled air is connected during a reduced power such as aircraft's cruise condition. The higher stage, obviously, is at the higher temperature so as to heat the bore area and cause the disks to grow radially outward and close the gap between the tips of the blades and its peripheral seal. Also, the labyrinth seals 46 & 44 are likewise heated so as to maintain a minimal gap therebetween.

By proper modulation of valve 26 in response to appropriate commands, the temperature and volumetric flow of air can be suitably regulated. For an example of a control system that would be appropriate, reference should be made to the aforementioned Redinger patent, which is incorporated herein by reference.

It should be understood that the invention is not limited to the particular embodiments shown and described herein, but that various changes and modifications may be made without departing from the spirit and scope of this novel concept as defined by the following claims.

We claim:

1. An active clearance control for a gas turbine engine powering aircraft over and operating envelope including high powered and low powered conditions, said engine having a compressor section comprising a plurality of stages of axial compressors rotatably supported in the bore area of the compressor section, each of said stages including a plurality of blades supported in a disc and each blade having a tip, an air seal circumscribing the tips of said blades and defining a gap between said tips and said air seal, and a row of stator vanes mounted ahead of the blades, means for selectively bleeding compressed air from one of said stages substantially at the middle of said stages and at another of said stages downstream therefrom relative to the air flow through said stages, means for feeding said bled air into the bore area adjacent the rotating axis of said plurality of stages of axial compressors, said feeding means including at least one hollow stator vane in one of said rows of stator vanes, and an anti-vortex tube extending from the inner diameter of the hollow stator vane radially inward toward said rotating axis, and control means for modulating said selective bleeding means for admitting compressed air to said bore by said feeding means to heat said discs so that said discs expand toward the air seal and close said gap between said air seal and the tips of said blades during the lower powered condition of said engine.

2. An active clearance control as in claim 1 including labyrinth seals having lands on the inner diameter of the stator vanes and cooperating depending members extending from the outer diameter of said discs defining therebetween a gap, said control means for controlling said selective bleeding means for admitting compressed air to said bore area by said feeding means to heat said disc so as to expand the depending member to minimize said gap of the labyrinth seals during said lower powered condition.

3. An active clearance control as in claim 2 wherein said control means for selectively preventing the flow of compressed air from said downstream-stage from entering said bore area during transient high powered conditions of the engine operations includes a valve.

4. An active clearance control as in claim 1 wherein said lower powered condition is the cruise flight mode of the aircraft.

* * * * *